US010709253B2

(12) United States Patent
Khandrika

(10) Patent No.: US 10,709,253 B2
(45) **Date of Patent: *Jul. 14, 2020**

(54) MULTI-PURPOSE, MULTI-UTILITY, AND RE-ORGANIZABLE RECLINER CHAIR BED

(71) Applicant: Krishna Mohan Naga Venkata Khandrika, Santa Clara, CA (US)

(72) Inventor: Krishna Mohan Naga Venkata Khandrika, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/109,740

(22) Filed: Aug. 23, 2018

(65) Prior Publication Data

US 2018/0368580 A1 Dec. 27, 2018

Related U.S. Application Data

(63) Continuation of application No. 15/261,949, filed on Sep. 11, 2016, now Pat. No. 10,098,472.

(60) Provisional application No. 62/232,655, filed on Sep. 25, 2015.

(51) Int. Cl.

| | |
|---|---|
| ***A47C 17/16*** | (2006.01) |
| ***A61G 5/00*** | (2006.01) |
| ***A61G 7/05*** | (2006.01) |
| ***A47C 1/02*** | (2006.01) |
| ***A47C 7/00*** | (2006.01) |
| ***A47C 7/42*** | (2006.01) |
| ***A47C 7/50*** | (2006.01) |
| ***A47C 7/54*** | (2006.01) |
| ***A61G 5/10*** | (2006.01) |
| ***A61G 7/00*** | (2006.01) |
| ***A61G 7/015*** | (2006.01) |

(52) U.S. Cl.

CPC ..... *A47C 17/162* (2013.01); *A47C 1/02* (2013.01); *A47C 7/006* (2013.01); *A47C 7/42* (2013.01); *A47C 7/506* (2013.01); *A47C 7/546* (2013.01); *A61G 5/006* (2013.01); *A61G 5/1002* (2013.01); *A61G 7/0005* (2013.01); *A61G 7/015* (2013.01); *A61G 7/0506* (2013.01); *A61G 7/0514* (2016.11)

(58) Field of Classification Search

CPC ..... A47C 17/16; A47C 17/162; A47C 17/163; A61G 5/006; A61G 7/015; A61G 7/0506; A61G 5/0514

See application file for complete search history.

(56) References Cited

U.S. PATENT DOCUMENTS

| | | | | | |
|---|---|---|---|---|---|
| 365,619 | A * | 6/1887 | Miller | A47C 17/16 | 5/39 |
| 1,984,311 | A * | 12/1934 | Lamar | A47C 17/163 | 182/139 |
| 2,034,985 | A * | 3/1936 | Lilley | A47C 17/163 | 297/68 |

(Continued)

*Primary Examiner* — Frank B Vanaman

(57) ABSTRACT

A recliner chair bed includes a first frame, a second frame, a backrest, and a leg rest. The first frame has front and rear ends. The second frame fits comfortably and moves telescopically inside and outside of the first frame. The leg rest is attached to the front end of the first frame. The backrest is attached to the rear end of the first frame. The independent movement of the back and leg rests helps in achieving desired position for comfort. The recliner chair bed provides stability, can be moved on to any fixtures such as furniture and toilet and also can be converted into a bed.

17 Claims, 6 Drawing Sheets

(56) References Cited

U.S. PATENT DOCUMENTS

| | | | | | |
|---|---|---|---|---|---|
| 3,137,511 | A * | 6/1964 | Weil | A61G 5/006 | 280/30 |
| 4,997,200 | A * | 3/1991 | Earls | A61G 5/006 | 280/304 |
| 5,050,899 | A * | 9/1991 | Stensby | A61G 5/006 | 280/250.1 |
| 5,333,887 | A * | 8/1994 | Luther | A61G 5/006 | 280/250.1 |
| 5,695,248 | A * | 12/1997 | Bell | A47C 3/30 | 297/252 |
| 5,860,664 | A * | 1/1999 | Smith | A61G 5/006 | 108/44 |
| 8,398,108 | B2 * | 3/2013 | Andrews | A61G 5/1059 | 280/250.1 |
| 2004/0227331 | A1 * | 11/2004 | Chen | A61G 5/006 | 280/650 |
| 2008/0100036 | A1 * | 5/2008 | Ivanchenko | A61G 5/006 | 280/648 |
| 2012/0246830 | A1 * | 10/2012 | Hornbach | A61G 7/015 | 5/619 |
| 2017/0086594 | A1 * | 3/2017 | Khandrika | A47C 7/506 | |

* cited by examiner

MULTI-PURPOSE, MULTI-UTILITY, AND RE-ORGANIZABLE RECLINER CHAIR BED

CROSS-REFERENCE TO RELATED APPLICATIONS

This application is a continuation of my application Ser. No. 15/261,949, filed on 11 Sep. 2016, which, in turn, claims the benefit of and priority to provisional application Ser. No. 62/232,655, filed on 25 Sep. 2015.

BACKGROUND

Field of the Invention

The present invention relates to a multi-purpose, multi-utility, and reorganizable recliner chair bed. More particularly, the present invention relates to the recliner chair that can be converted into a bed.

Description of the Related Art

Recliner chairs that can be converted into beds are well known in the art. A recliner chair typically includes a seat rest, a backrest, and a leg rest. The reclining chair may be adjusted into an upright position and one or more reclined positions. The reclining chair may be used for ordinary household use. The existing recliner chairs do not convert into flat beds in their fully reclined position. Moreover, the recliner chair may tilt backwards in fully reclined position since the backrest is supported only through linkages.

Elderly, paralyzed, severely sick, and disabled people need special equipment to go through daily activities. A bedridden person needs to move around to go through daily activities, to maintain hygiene, and to keep mental health. In case a care giver is assisting the bedridden person in shifting, moving, and lifting, it is risky, cumbersome and painful to both the bedridden person and the care giver. Moreover, maintaining hygienic conditions near the bed is cumbersome. The existing recliner chairs fail to solve the problems of the bedridden people.

Conventionally, various types of wheelchairs with an opening for toilet use are known. A wheelchair has a seat plate with an opening. A receptacle is mounted underneath the opening for collecting the excreta and urine. This design provides a certain degree of convenience. However, the bedridden person is not able to sit for an extended time as these types of wheelchairs are normally not fitted with an adjustable backrest. Moreover, the wheelchairs do not convert to fully reclined position and the bedridden person has to be transferred to a bed from the wheelchair.

To overcome the above mentioned drawbacks, U.S. Pat. No. 8,359,685 proposes a wheelchair with a commode that can be converted into a bed. The wheelchair includes an outer rectangular main frame standing on at least four wheeled legs and is connected to first, second, third, and fourth frames by pivots or hinges. The movements of the first, second, third, and fourth frames allow the wheelchair to be converted into a bed and vice-versa. A commode pan or pot is fitted under the outer rectangular main frame. Further, a cushion is provided between the outer rectangular main frame and the commode pan or pot. The second and third frames support back and legs of a person, respectively. The major drawback of this type of wheelchair is that the second and third frames are interconnected, thereby preventing the independent movement of the second and third frames. Moreover, a person with leg or knee injuries may be forced to fold the legs while using as a wheelchair. Hence, the wheelchair fails to achieve a desirable position for comfort. Also, maintenance of hygienic conditions and changing of commode pan or pot is cumbersome for care takers and wheelchair cannot be moved onto a commode. Furthermore, the wheelchair is not foldable and it occupies a large space. Moreover, the wheelchair fails to provide lifting or tilting support for patients.

To maintain hygienic conditions, the bedridden person has to be taken near to a commode. The bedridden person is maneuvered by a chair towards the commode and the bedridden person has to be transferred on to the commode. This maneuver or transfer may be difficult or impossible for some bedridden people. Hence, there is a need for a chair that is easily movable on to a commode to maintain hygienic conditions and to avoid the transfer of the patient. Further, there is a need for a reclining chair that is adjustable to any desired position.

In light of the foregoing discussion, there exists a need for a chair that can be moved on to any object or fixture, can be converted into a bed, is adjustable to any desired position, and that addresses the above mentioned drawbacks of the prior art chair beds.

SUMMARY

An object of the present invention is to provide a multi-purpose, multi-utility, and reorganizable recliner chair bed. The recliner chair bed includes a first frame, a second frame, a backrest, and a leg rest. The first frame has front and rear ends. The first frame allows the second frame to move telescopically in and out of the first frame. The first and second frames form a hollow space that allows the movement of the recliner chair bed onto fixtures or other objects. The leg rest is attached to the front end of the first frame. The backrest is attached to the rear end of the first frame. When the reclining chair bed is in sitting position, the backrest and the leg rest are in a vertical (or near vertical) position with respect to the ground and the second frame is inside the first frame. When the reclining chair bed is in sleeping position, the backrest and the leg rest are in a horizontal (or near horizontal) position with respect to the ground and the second frame is pulled out of the first frame to support the backrest. The independent movement of the back and leg rests helps in an easy adjustment of the recliner chair bed to desired positions for comfort. Various mechanisms in the recliner chair bed can be operated either mechanically or electrically or by using a combination. Also, the recliner chair can be driven manually or electrically or by using a combination.

Another object of the present invention is to provide desired support to a person by providing a tiltable seat for the recliner chair bed. The seat is lifted or tilted with help of linear actuators to allow the person to easily get off the recliner chair bed in a sitting position.

The recliner chair bed can be folded and therefore can be accommodated in a small space. The recliner chair bed has good stability and can be used as single unit for multiple purposes and multiple uses. The recliner chair bed provides safety, convenience, and comfort to the elderly and disabled people. The recliner chair bed provides hygienic conditions and is easy to clean and operate.

BRIEF DESCRIPTION OF DRAWINGS

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of system components which constitutes multi-purpose, multi-utility, and reorganizable recliner chair bed. Accordingly, the components have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1A:
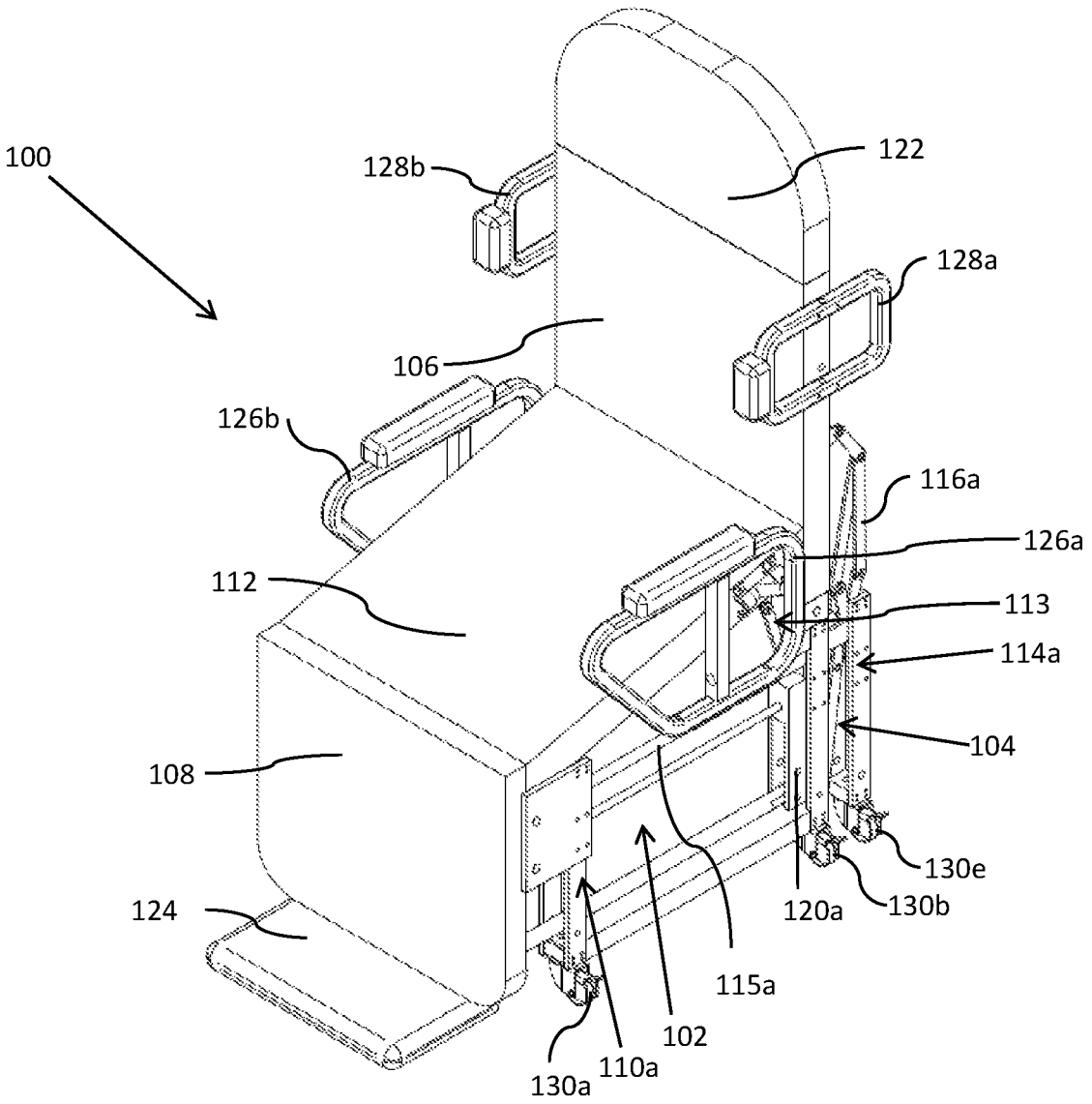
FIG. 1A shows a perspective view of a recliner chair bed in a sitting position, according to an illustrative embodiment of the disclosure.
Figure 1B:
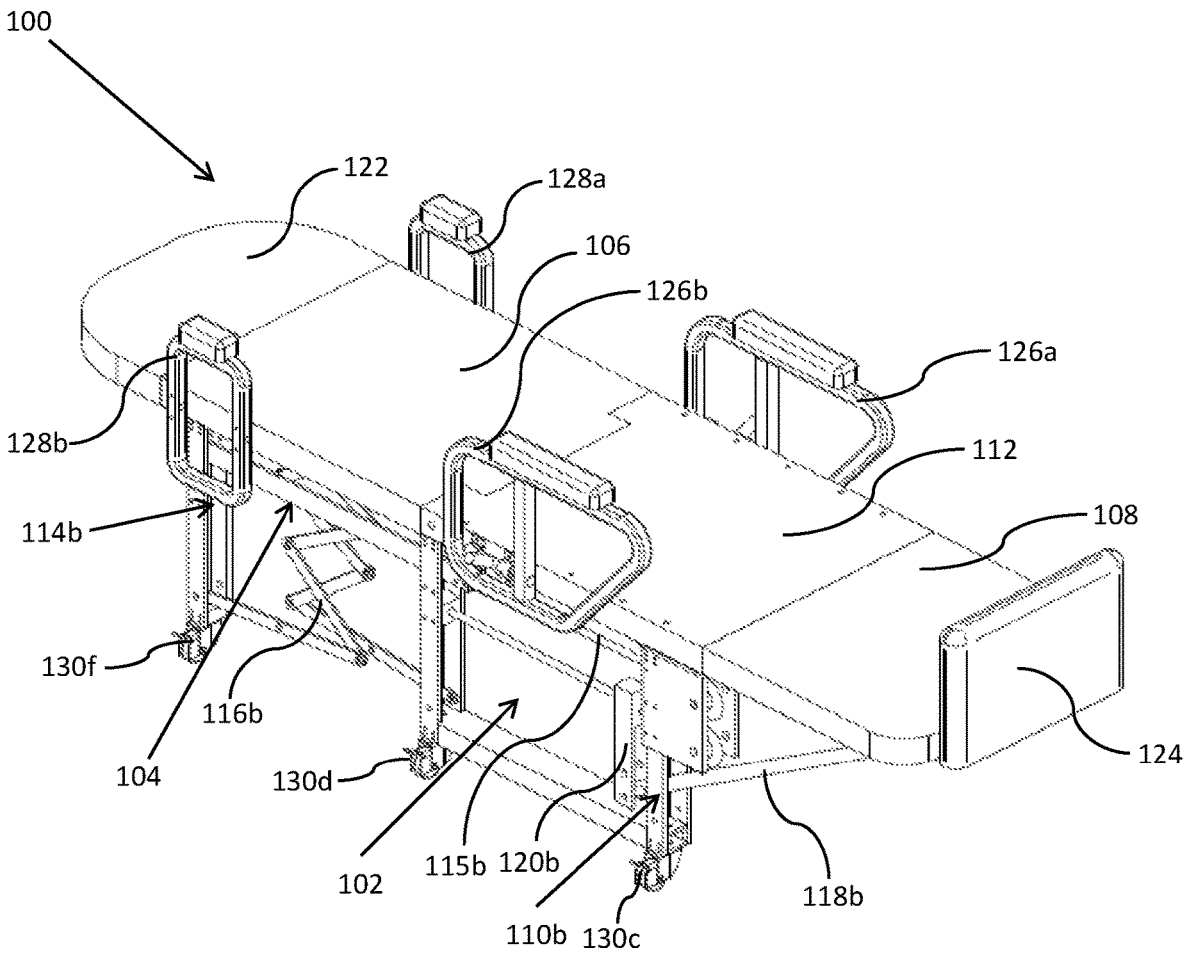
FIG. 1B shows a perspective view of the recliner chair bed in a sleeping position, according to an illustrative embodiment of the disclosure.

The recliner chair bed 100 is a multi-purpose, multi-utility, and reorganizable chair and is used for daily activities. The recliner chair bed 100 is a recliner chair that converts into a bed. FIGS. 1A and 1B illustrate the recliner chair bed 100 in a sitting position and a sleeping position, respectively. The recliner chair bed 100 includes a first frame 102, a second frame 104, a backrest 106, and a leg rest 108. The sitting position is also referred to as an upright position.

FIGS. 1A and 1B illustrate the first frame 102 that has front and rear ends. The first frame includes a first set of supports 110*a*-110*b* and a seat 112. The first set of supports 110*a*-110*b* includes first support 110*a* and a second support 110*b* that are spaced apart from each other. In an embodiment, each of the first and second supports 110*a* and 110*b* is a rectangular subframe. In yet another embodiment, the set of supports 110*a*-110*b* may be four support legs (not shown) that are spaced apart from each other. The seat 112 having first and second ends is supported on the first set of supports 110*a*-110*b*. The seat 112 allows a person to rest on the recliner chair bed 100. A cushion may be provided on the seat 112 for additional comfort.

In an embodiment, the first and second ends of the seat 112 are pivoted to corresponding front and rear ends of the first and second supports 110*a*-110*b*, respectively. In another embodiment, the second end of the seat 112 is attached to a set of linear actuators, such as lead screws (not shown) positioned on the rear ends of the first and second supports 110*a*-110*b*, and the first end of the seat 112 is pivoted to the front ends of the first and second supports 110*a*-110*b*. The linear motion of the set of linear actuators is achieved by rotating a first handle (not shown) that is fixed to the first frame 102. When the first handle is rotated, the lead screws move linearly in vertical direction with respect to the ground and lift or lower the second end of the seat 112. The vertical movement of the seat 112 helps the person sit at a comfortable height and in a comfortable position on the recliner chair bed 100. The set of linear actuators form a lifting mechanism 113 for the seat 112. The lifting mechanism 113 allows the seat 112 to be tiltable. Moreover, the vertical movement of the seat 112 provides an additional support to the person to easily get off the recliner chair bed 100. The vertical movement of the seat 112 may also be achieved by hydraulic shafts and also by means of motors, such as servomotors and step motors. In yet another embodiment, the first end of the set 112 may be attached to the set of linear actuators.

FIGS. 1A and 1B illustrate the second frame 104 having front and rear ends that includes a second set of supports 114*a*-114*b* spaced apart from each other. The first and second frames 102 and 104 are telescopically engageable with and retractable from each other. The second frame 104 fits comfortably inside the first frame 102. Moreover, the second frame 104 can be pulled out of the first frame 102 to any desired distance from the first frame 102. It will be apparent to a person skilled in the art that the first frame 102 can also be moved into the second frame 104.

The recliner chair bed 100 includes a guiding mechanism (not shown) that helps the second frame 104 to adjust telescopically into and out of the first frame 102. In an embodiment, the first and second supports 110*a*-110*b* of the first frame 102 have guide rails that help in achieving linear movements of the first and second supports 114*a* and 114*b* of the second frame 104 into and out of the first and second supports 110*a* and 110*b*, respectively. Such guiding mechanisms having guide rails are well known in the art and further description of them is omitted for the sake of brevity. In another embodiment, the first and second supports 110*a* and 110*b* of the first frame 102 each include one or more channels. The front end of the second frame 104 i.e., front ends of the first and second supports 114*a* and 114*b* are attached with one or more wheels that help in linear movement on the one or more channels. The wheels reduce friction and ease the movement of the second frame 104 into and out of the first frame 102. In yet another embodiment, the first and second frames 102 and 104 have telescopic tubes (not shown) that help in achieving the telescopic movement between the first and second frames 102 and 104.

In an embodiment, the second frame 104 is mechanically driven with a set of linear actuators 115*a* and 115*b*, such as lead screws. The lead screws convert a rotary motion into a linear motion. The set of linear actuators 115*a* and 115*b* is positioned on the first frame 102 and is attached to the second frame 104. The set of linear actuators 115*a* and 115*b* is arranged and positioned in a way that the rotation of a second handle (not shown) allows the set of lead screws to rotate. The rotation of the set of linear actuators 115*a* and 115*b* in turn achieves the linear movement of the second frame 104 into the first frame 102. The second handle is fixed to the first frame 102. In another embodiment, the second frame 104 is electrically driven with the help of an actuating means, such as an electric motor. In yet another embodiment, the second frame 104 is driven with the help of acme screws and gears, such as spur, worm, bevel, or helical gears. In yet another embodiment, the second frame 104 is driven with the help of a chain or a belt. In order to achieve the movement for the second frame 104 with respect to the first frame 102, any suitable mechanism may be used without departing from scope and spirit of the present invention.

The first and second frames 102 and 104 define a hollow space therebetween. The hollow space is formed by the first and second supports 110*a* and 110*b*, and the seat 112 of the first frame 102. As the first and second frames 102 and 104 slide through each other, the hollow space formed remains free of obstruction from frames/links. The hollow space allows the recliner chair bed 100 to move onto any desirable object or fixture such as a toilet commode, a cabin suit case, and the like. Moreover, the hollow space allows the recliner chair bed 100 to be used in constrained spaces such as RVs, airplanes, and small rooms.

The backrest 106 has first and second ends. The first end of the backrest 106 is attached to the rear end of the first frame 102. The recliner chair bed 100 further includes a first scissor lift mechanism 116*a* and a second scissor lift mechanism 116*b*. The first scissor lift mechanism 116*a* and the second scissor lift mechanism 116*b* hold the backrest 106 in a near vertical position or at any comfortable position with respect to the ground. First ends of the first scissor lift mechanism 116*a* and the second scissor lift mechanism 116*b* are attached to the backrest 106. Second ends of the first scissor lift mechanism 116*a* and the second scissor lift mechanism 116*b* are attached to the first and second frames 102 and 104. The movement of the second frame 104 with respect to the first frame 102 automatically adjusts the first scissor lift mechanism 116*a* and the second scissor lift mechanism 116*b*. The automatic adjustment of the first scissor lift mechanism 116*a* and the second scissor lift mechanism 116*b* by movement of the second frame 104 helps the backrest 106 in achieving any desired position. The second frame 104 along with the scissor lift mechanisms provides the desired stability to the backrest 106. In an embodiment, a first set of links (not shown) is attached to the backrest 106 and the second frame 104 to hold the backrest 106 in the vertical position or at any comfortable position. The first set of links is attached to a set of linear actuators such as lead screws, which in turn are attached to the rear end of the second frame 104. The rotation of the lead screws allows the backrest 106 to achieve any desired position. In order to adjust the first set of links on the second frame 104, any suitable mechanism may be used without departing from scope and spirit of the present invention. The backrest 106 can be adjusted to any position through any other suitable mechanism without departing from the scope of the invention. Moreover, the second frame 104 is pulled out to a desired distance from the first frame 102 to provide additional support to the backrest 106 in all positions.

The leg rest 108 having first and second ends is attached to the front end of the first frame 102. A second set of links 118*a* and 118*b* having first and second ends holds the leg rest 108 in a horizontal position or at any comfortable position. The first ends of the second set of links 118*a* and 118*b* are attached to the leg rest 108. The second ends of the second set of links 118*a* and 118*b* are adjusted to achieve desired position of the leg rest 108. In an embodiment, the second ends of the second set of links 118*a* and 118*b* are attached to a set of shafts 120*a*-120*b*. The set of shafts 120*a*-120*b* are attached to a set of linear actuators such as screw rods, which in turn are attached to the first and second supports 110*a* and 110*b* of the first frame 102. Each of the set of shafts 120*a*-120*b* is attached with one or more wheels that help in linear movement on the one or more channels. The set of linear actuators are rotated by rotating a third handle (not shown). The rotation of the set of linear actuators moves the set of shafts 120*a*-120*b* which in turn adjusts the second set of links 118*a* and 118*b*. The third handle is fixed to the first frame 102. The rotation of the third handle allows the leg rest 108 to achieve any desired position. The leg rest 108 can be adjusted to any position through any suitable mechanism without departing from the scope of the invention.

The back and leg rests 106 and 108 help the person rest the back and legs, respectively. FIGS. 1A and 1B illustrate the sitting position and the sleeping position of the recliner chair bed 100, respectively. In the sitting position, the backrest 106 and the leg rest 108 are positioned substantially vertical to the seat 112. In the sleeping position, the backrest 106 and the leg rest 108 are positioned substantially horizontal to the seat 112. In an embodiment, the back and leg rests 106 and 108 have cushions to provide additional comfort to the person. In another embodiment, the leg rest 108 can also move above the horizontal plane of the seat 112 to allow the person to position his/her legs in an elevated position. The sleeping position is achieved by pulling out the second frame 104 from the first frame 102 and positioning the back and leg rests 106 and 108 near horizontal with respect to the seat 112. The second frame 104 along with other links supports the backrest 106 in the sleeping position, thereby allowing the recliner chair bed 100 to convert into a flat bed.

Figure 1C:
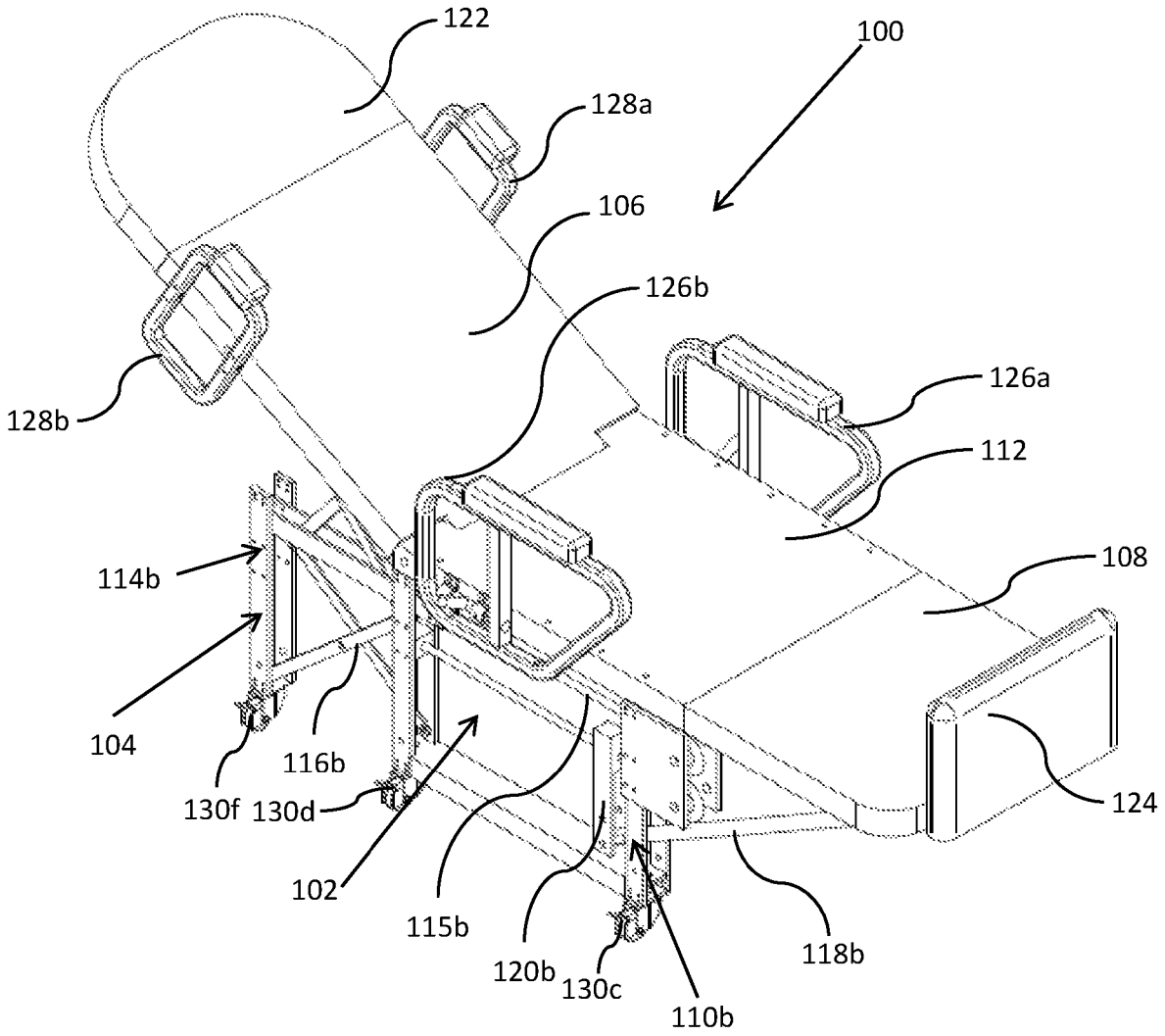
FIG. 1C shows a perspective view of the recliner chair bed with a backrest in an angled position, according to an illustrative embodiment of the disclosure.
Figure 1D:
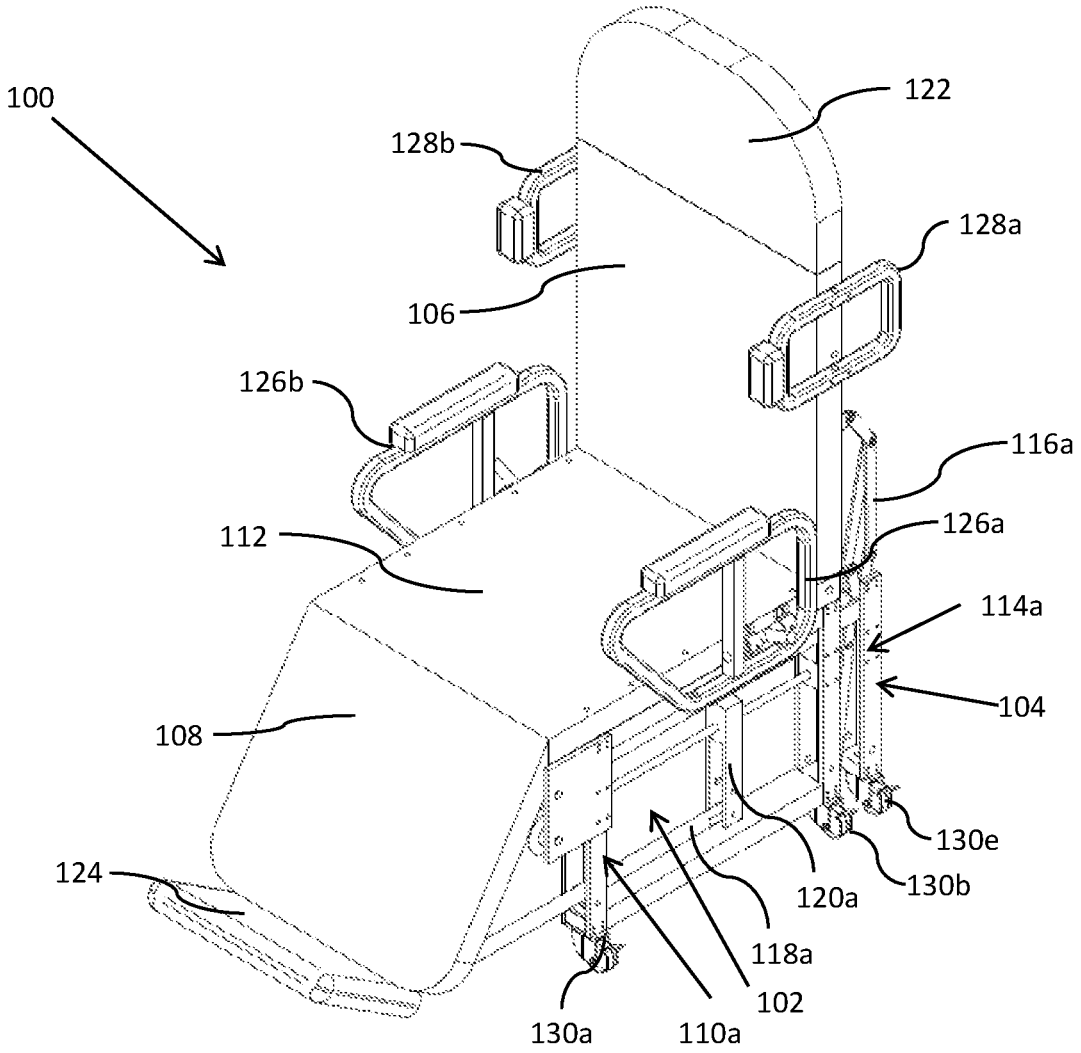
FIG. 1D shows a perspective view of the recliner chair bed with a leg rest in an angled position, according to an illustrative embodiment of the disclosure.

The back and leg rests 106 and 108 can be adjusted to any desired angle to achieve any position that suits the comforts of the person as shown in FIGS. 1C and 1D. FIGS. 1C and 1D illustrate the recliner chair bed 100 in angled positions. The movement of the back and leg rests 106 and 108 is independent of each other and helps achieve desired intermediate positions. In an embodiment, the movement of the back and leg rests 106 and 108 can be interlinked to operate together. In another embodiment, the guiding mechanisms of the second frame 104 and the leg rest 108 can be on the same axis or different axis. In yet another embodiment, the movement of the back and leg rests 106 and 108 is achieved by means of at least one motor. The motors operate independently and activate the back and leg rests 106 and 108 to move between near horizontal and near vertical positions with respect to the seat 112. The motors may be servomotors or step motors that are controlled using a controller.

In an embodiment, the recliner chair bed 100 further includes a back extension 122 that is attached to the second end of the backrest 106. The back extension 122, for example, helps a tall person to rest the head comfortably. The recliner chair bed 100 further includes a foot rest 124 that is attached to the second end of the leg rest 108. Moreover, the back extension 122 and the foot rest 124 are foldable, slidable, swivelable, detachable or a combination thereof. In another embodiment, the recliner chair bed 100 includes first and second armrests 126*a* and 126*b*. The first and second armrests 126*a* and 126*b* are mounted on sides of the first frame 102. The first and second armrests 126*a* and 126*b* provide necessary support to the person. The first and second armrests 126*a* and 126*b* are foldable, slidable, swivelable, detachable or a combination thereof. The recliner chair bed 100 further includes first and second side rails 128*a* and 128*b* that are mounted on sides of the backrest 106. The first and second side rails 128*a* and 128*b* provide safety and can be used to push the recliner chair bed 100. The first and second side rails 128*a* and 128*b* are foldable, slidable, swivelable, detachable or a combination thereof. First and second panels (not shown) are mounted on sides of the leg rest 108. The first and second panels are foldable, slidable, swivelable, detachable, or a combination thereof.

In an embodiment, the set of linear actuators 115*a* and 115*b* for the second frame 104 move synchronously to each other. Similarly, the set of linear actuators for the leg rest 108 move synchronously to each other. The recliner chair bed 100 is extended to a comfortable bed when the first and second armrests 126*a*-126*b*, the first and second rails 128*a*-128*b*, and the first and second panels are unfolded in the sleeping position of the recliner chair bed 100. In another embodiment, the first and second frames 102 and 104 are covered with easily cleanable material so that the recliner chair bed 100 is easy to clean and disinfect. The recliner chair bed 100 is easily reorganizable such that multiple chair beds can be joined adjacent to each other to form a more comfortable bed.

Figure 2:
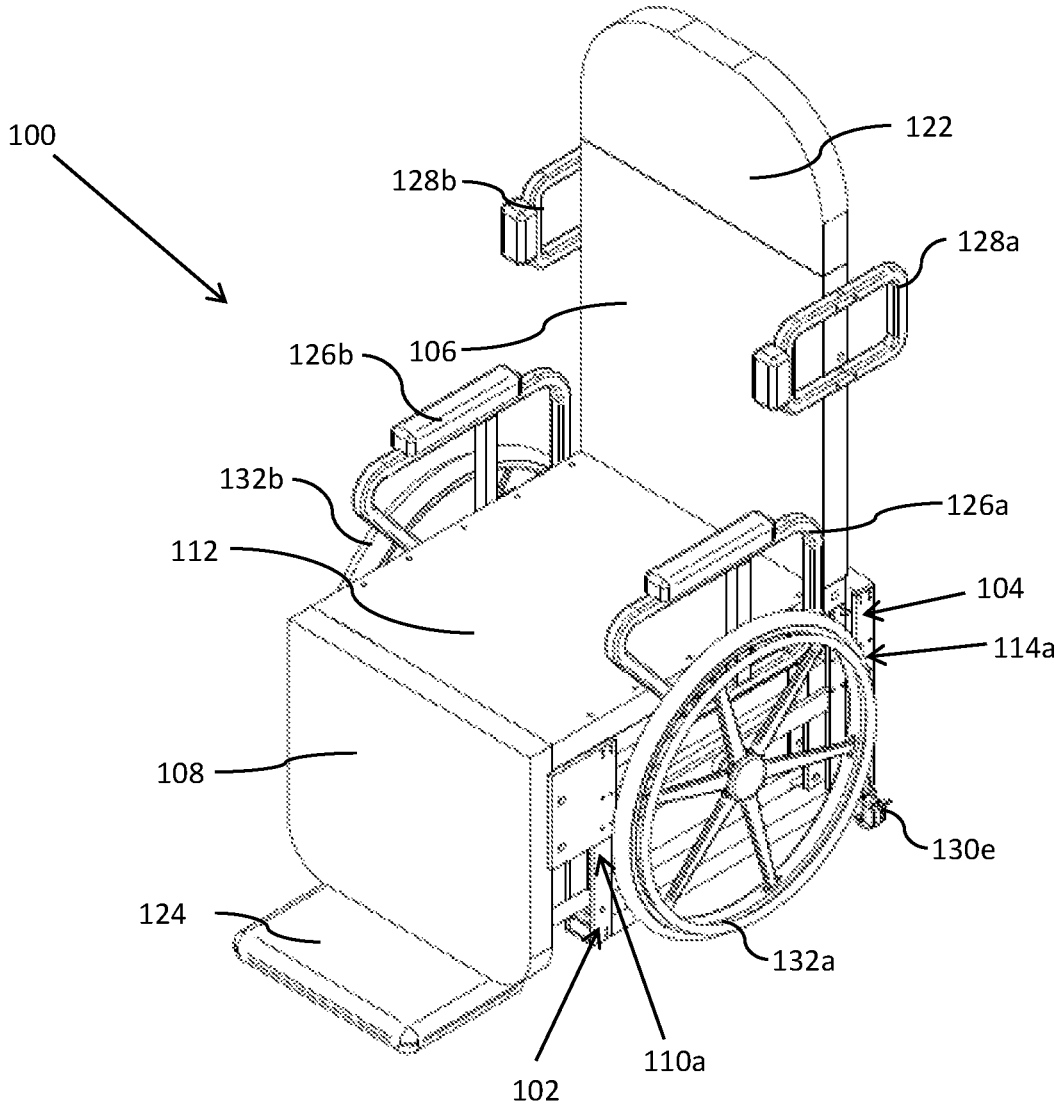
FIG. 2 shows a perspective view of the recliner chair bed with side wheels, according to an illustrative embodiment of the disclosure.

In an embodiment, caster wheels 130*a*-130*f* are attached to the lower ends of the supports for the first and second frames 102 and 104. The caster wheels 130*a*-130*f* help the recliner chair bed 100 move easily from one place to another. In another embodiment, 130*a*-130*f* can be level casters, which help the recliner chair bed 100 to be rigid while stationary or mobile. In yet another embodiment, the recliner chair bed 100 can also be fitted with side wheels 132*a*-132*b* as shown in FIG. 2. The rotation of the side wheels 132*a*-132*b* allows a person to move around on the recliner chair bed 100.

In an embodiment, the recliner chair bed 100 has a pair of handles (not shown) attached to the backrest 106 by which the recliner chair bed 100 can be pushed or pulled for mobility. In another embodiment, the recliner chair bed 100 includes an adjustable lumbar support (not shown) that is attached to the backrest 106. In yet another embodiment, the recliner chair bed 100 includes an adjustable neck support (not shown) that is attached to the backrest 106.

Figure 3:
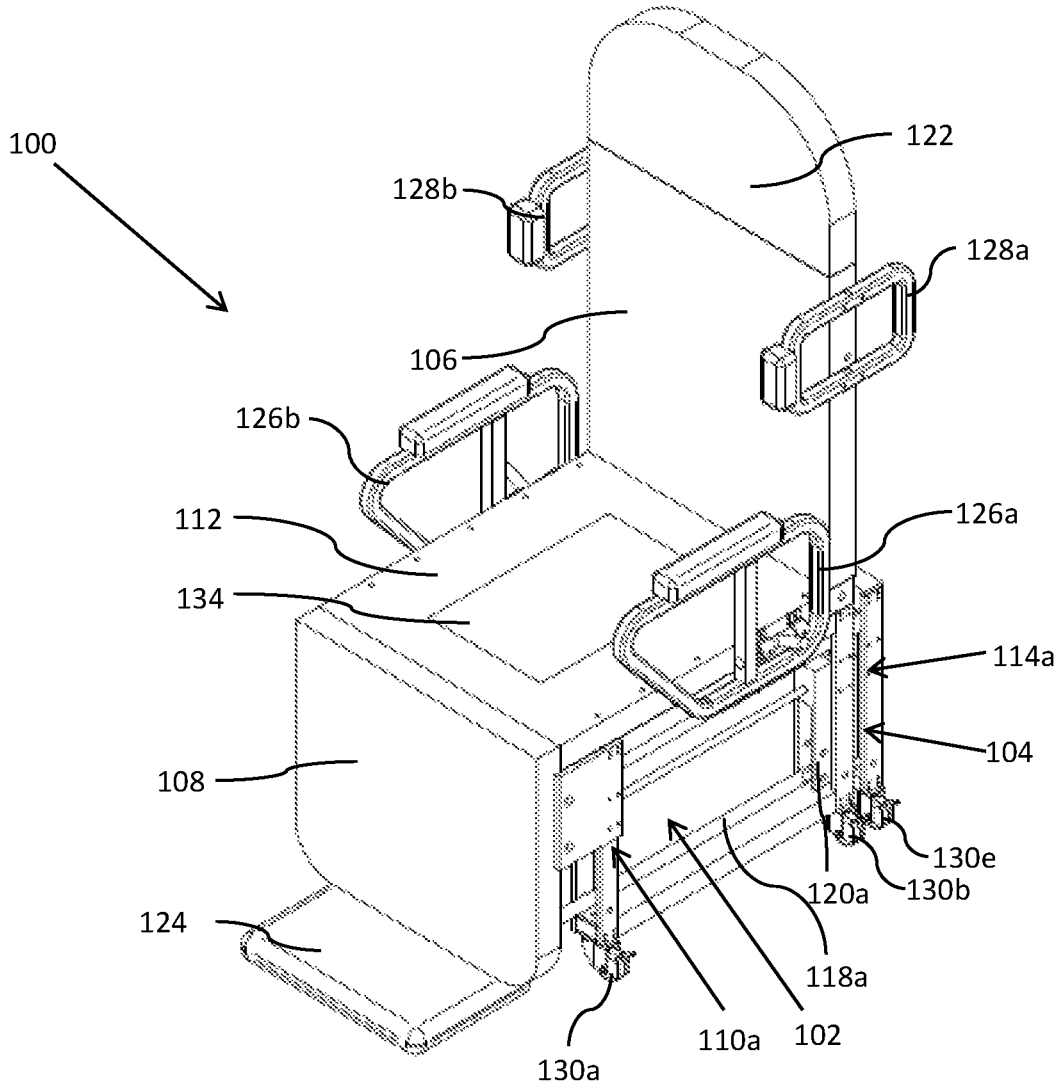
FIG. 3 shows a perspective view of the recliner chair bed with an opening, according to an illustrative embodiment of the disclosure.

In an embodiment, the seat 112 has an opening 134 which is of a rectangular cross-section as illustrated in FIG. 3. The opening may be of any other shape. The recliner chair bed 100 in sitting or angled position is moved near to a toilet, such as commode and can be positioned over the commode. The opening 134 on the seat 112 can be aligned to top of the commode. The opening 134 on the seat 112 can be closed with help of a cover when not in use. In an embodiment, the cover of the opening 134 on the seat 112 is a slidable door. The opening 134 and the door to cover it can be of any suitable design without departing from scope and spirit of the present invention.

According to an embodiment of the present invention, the recliner chair bed 100 is foldable to reorganize for space and convenience. The first set of supports 110*a* and 110*b*, and second set of supports 114*a* and 144*b* are connected with collapsible links, respectively. The links can be collapsed to fold the recliner chair bed 100. Moreover, the seat 112 may be made of leather or any other suitable material such that the seat 112 can be folded when the links are collapsed. The recliner chair bed 100 is nearly a flat bed when it is fully expanded and does not tilt backwards due to additional support provided by the second frame 104. The recliner chair bed 100 can be used as lifting chair, toilet chair, bathing chair, patient transfer equipment, wheelchair, and a bed. In an embodiment, the first and second frames 102 and 104, and other components such as the back and leg rests 106 and 108, the second set of links 118*a* and 118*b*, the back extension 122, and the foot rest 124 of the recliner chair bed 100 may be made of aluminum, steel, stainless steel, copper, wood, plastic, brass, any other materials or a combination thereof. The recliner chair bed 100 of the present invention can be manufactured in various sizes suitable for persons of different sizes. Any suitable material of cushion is provided on the first frame 102, the backrest 106, the leg rest 108, the back extension 122, and the foot rest 124. The present invention of the recliner chair bed 100 is not only used as wheelchair for bedridden people but also it may be used as recliner chair for normal people.

The recliner chair bed 100 can be easily maneuvered and moved onto any object or fixture that fits in the provided dimensions. The recliner chair bed 100 is convertible to any position between sitting position and the sleeping position to desired needs of a person to provide desired comfort. The recliner chair bed 100 is foldable, provides stability, and solves the mobility issues of old people and bedridden patients. Elderly people and bedridden patients can use the recliner chair bed 100 as a single unit for all their activities. The recliner chair bed 100 can be cleaned and sanitized easily. The recliner chair bed 100 provides hygienic conditions for care giver and patient. The recliner chair bed 100 provides safety, convenience and comfort to people. The recliner chair bed 100 can be used for ordinary household use, patient handling, hospitality needs, and any other situations where chair and bed features are required.

The present invention has been described herein with reference to a particular embodiment for a particular application. Although selected embodiments have been illustrated and described in detail, it may be understood that various substitutions and alterations are possible. Those with ordinary skill in the art and access to the present teachings may recognize various additional substitutions and alterations are also possible without departing from the spirit and scope of the present invention, and as defined by the following claims.

The invention claimed is:

1. A recliner chair comprising:

a first frame having a set of supports and a seat that is supported on the set of supports;

a second frame having a set of supports, wherein the first and second frames are telescopically engaged with each other;

a backrest attached to the first frame, wherein the backrest is adjustable to a plurality of positions between a substantially vertical position and a substantially horizontal position; and one or more scissor linkages attached to the back rest, the first frame, and the second frame, wherein each scissor linkage includes a first bottom end, a second bottom end, and at least one top end, wherein the first bottom end is attached to the first frame, the second bottom end is attached to the second frame, and the at least one top end is attached to the backrest, and wherein when the second frame is moved with respect to the first frame, the one or more scissor linkages adjust angular movement between the backrest and the seat such that the one or more scissor linkages support the backrest in the plurality of positions.

2. The recliner chair of claim 1 further comprising a leg rest attached to the first frame.

3. The recliner chair of claim 2 further comprising a foot rest that is attached to the leg rest, wherein the foot rest is foldable, slidable, swivelable, detachable or a combination thereof.

4. The recliner chair of claim 2, wherein the backrest and the leg rest move independent of each other.

5. The recliner chair of claim 1 further comprising a back extension that is attached to the backrest, wherein the back extension is foldable, slidable, swivelable, detachable or a combination thereof.

6. The recliner chair of claim 1 further comprising a set of caster wheels that is attached to the first and second frames.

7. The recliner chair of claim 1 further comprising a set of linear actuators attached to the first frame and the second frame, wherein the set of linear actuators facilitates a linear movement of the second frame.

8. The recliner chair of claim 1 further comprising a lifting mechanism that raises and lowers an end of the seat.

9. The recliner chair of claim 1 further comprising first and second armrests, wherein each of the first and second armrests is attached on a side of the first frame, and wherein the first and second armrests are foldable, slidable, swivelable, detachable or a combination thereof.

10. The recliner chair of claim 1 further comprising first and second side rails, wherein each of the first and second side rails is attached on a side of the backrest, and wherein the first and second side rails are foldable, slidable, swivelable, detachable or a combination thereof.

11. The recliner chair of claim 1 is operated and driven manually, electrically or a combination thereof.

12. The recliner chair of claim 1 further comprising a first cushion and a second cushion, wherein the first and second cushions are rested on the seat and the backrest, respectively.

13. The recliner chair of claim 1, wherein the first and second frames and the backrest are made of aluminum, steel, stainless steel, copper, wood, plastic, brass or a combination thereof.

14. A recliner chair comprising:

a first frame having a set of supports and a seat that is supported on the set of supports;

a second frame having a set of supports, wherein the first and second frames are telescopically engaged with each other;

a backrest attached to the first frame, wherein the backrest is adjustable to a plurality of positions between a substantially vertical position and a substantially horizontal position; and one or more scissor linkages attached to the back rest, the first frame, and the second frame, wherein each scissor linkage includes a first bottom end, a second bottom end, and at least one top end, wherein the first bottom end is attached to the first frame, the second bottom end is attached to the second frame, and the at least one top end is attached to the backrest, and wherein when the second frame is moved with respect to the first frame, the one or more scissor linkages adjust angular movement between the backrest and the seat such that the one or more scissor linkages support the backrest in the plurality of positions, and wherein the first and second frames define a hollow space therebetween.

15. The recliner chair of claim 14 further comprising a leg rest attached to the first frame.

16. The recliner chair of claim 14 further comprising a set of linear actuators attached to the first frame and the second frame, wherein the set of linear actuators facilitates a linear movement of the second frame.

17. The recliner chair of claim 14 is operated and driven manually, electrically or a combination thereof.

* * * * *